US005183644A

United States Patent [19]

Martensson et al.

[11] Patent Number: 5,183,644

[45] Date of Patent: Feb. 2, 1993

[54] APPARATUS FOR TREATING PACKAGE CONTAINER BLANKS

[75] Inventors: Lars Martensson, Veberod; Jan Andersson, Ystad, both of Sweden

[73] Assignee: Tetra Alfa Holdings SA, Pully, Switzerland

[21] Appl. No.: 686,154

[22] Filed: Apr. 16, 1991

[30] Foreign Application Priority Data

Apr. 27, 1990 [SE] Sweden ..... 9001534

[51] Int. Cl.[5] ..... A61L 2/00; B08B 3/00; B65B 55/04

[52] U.S. Cl. ..... 422/304; 422/300; 422/302; 134/102.2; 134/153; 134/169 R; 134/61; 141/92; 53/426; 53/167

[58] Field of Search ..... 422/28, 300, 302, 304, 422/303; 141/89, 92; 134/61, 62, 80, 81, 102, 142, 153, 158; 53/167, 426

[56] References Cited

U.S. PATENT DOCUMENTS 3,018,184 1/1962 Martin ..... 426/399
4,161,356 7/1979 Giffin et al. ..... 134/153
5,053,196 10/1991 Ide et al. ..... 422/304

FOREIGN PATENT DOCUMENTS 0035238 9/1981 European Pat. Off. ..... 134/81
0045389 2/1982 European Pat. Off. .
0232998 8/1987 European Pat. Off. .
0356011 2/1990 European Pat. Off. .

*Primary Examiner*—Robert J. Warden
*Assistant Examiner*—Theresa A. Trembley
*Attorney, Agent, or Firm*—Burns, Doane, Swecker & Mathis

[57] ABSTRACT

An apparatus for treating a package container blank with a fluid is disclosed and includes a rotary portion provided with a plurality of chambers for receiving the blanks and a fixed portion having a stator surface that faces the rotary portion. The fixed portion is provided with an arrangement that opens to the stator surface for supplying fluid so that upon successive rotations of the rotary member, the chambers will successively align with the arrangement for supplying fluid so that fluid is thereby supplied to the chambers.

16 Claims, 3 Drawing Sheets

APPARATUS FOR TREATING PACKAGE CONTAINER BLANKS

FIELD OF THE INVENTION

The present invention relates to an apparatus for treating package container blanks. More specifically, the present invention pertains to an apparatus for sterilizing package container blanks through use of a vaporized or gaseous fluid.

BACKGROUND ART

In the production of package containers for foods, extremely high demands are placed on cleanliness and hygiene, with a view to reducing the population of bacteria in the finished package container. It generally applies that the more the population of bacteria in a package container can be reduced, the longer will be the shelf-life of the packed product, of course on condition that the package container is completely bacteria-proof, so that bacteria cannot penetrate in from the outside after sealing of the package. A special type of package container consists of the so-called sterile or aseptic package containers which are filled with previously sterilized (for example heat-treated) contents such as milk or juice. In the production of package containers of this type, a treatment is required with disinfectant agents, normally hydrogen peroxide ($H_2O_2$) in the vaporized or gaseous state in order to ensure that the population of bacteria in the package container has been reduced to a sufficient degree to guarantee, after filling and sealing of the package container, a desired lengthy shelf-life, on the order of several months.

Package containers of the above-mentioned type, i.e. package containers of the disposable type intended for liquid contents such as milk and juice, are normally produced from a packaging laminate which includes a carrier layer of fibrous material, for example paper, which is coated on either side with a thermoplastic material, primarily polyethylene. The packaging laminate may also include other layers, for example gas barrier layers such as aluminium foil or the like. After reforming of the packaging laminate into tubular blanks fitted with a bottom, these blanks are subjected, prior to filling with previously sterilized contents, to a sterilization treatment, i.e. a so-called commercial sterilization, with a view to reducing the population of viable bacteria to a level acceptable for achieving desired product shelf-life. The sterilization normally takes place in that a gaseous or vaporized chemical sterilization container during a sufficient period of time, whereafter the agent is removed by the package container being exposed to a current of hot sterile air until all residues of the employed sterilization agent have reliably been extracted. During this treatment, the individual package container blank is, in prior art apparatuses, enclosed in a chamber which, by the intermediary of channels and valves, is connectible both to a source of sterilization agent and to a source of sterile hot air. The package container blank is moved via a gate into the above-mentioned chamber with the aid of a conveyor, and both filling of the package container and sealing of its upper portion must take place before the package container departs from the sterile area. This requires a relatively large amount of room and the sterile area must, hence, be of relatively large size, with the result that it may be difficult to guarantee that sterility can be maintained at all times. In itself, the conveyor which moves the package containers into and out of the sterile chamber also constitutes an infection risk, since all matter which is displaced from the ambient surroundings of the chamber into the chamber may entrain bacteria. On the whole, it is generally desirable within this art to reduce the degree and intensity of interaction between the chamber and its surroundings as far as is possible, for example by reducing to a minimum the still necessary area of the passages and by always ensuring that the pressure in the sterile chamber is slightly higher than the ambient pressure, so that leakage will always be one-way, from the inside and outwards. Despite the above-mentioned measures, it does happen in prior art apparatuses for treating package container blanks that bacteria may penetrate into the sterile area, which necessitates operational down-time and a specific sterilization, so-called presterilization, of the sterile area before production can be resumed.

The gate and conveyor arrangements which are necessary in prior art apparatuses are also relatively complex, with the result that mechanical problems at times occur and package container blanks become jammed and torn in the sterile chamber. In such an event, it is necessary to open the sterile chamber and manually remove the remains of the package container, and once again clean and presterilize the apparatus, implying a lengthy period of operational down-time during which the entire packaging machine must stand idle.

OBJECTS OF THE INVENTION

One object of the present invention is to devise an apparatus for treating, primarily sterilizing, package container blanks with the aid of a gaseous or vaporized fluid, the apparatus being of simple and reliable design and construction, which ensures superior functioning from both the aseptic and mechanical viewpoints.

A further object of the present invention is to provide an apparatus of the above-mentioned type in which the sterile area is of minimal volume and has least possible contact with its surroundings, with a view to reducing the risk of bacterial attack and penetration.

Yet a further object of the present invention is to provide an apparatus of the above-mentioned type in which the number of moving mechanical parts is reduced considerably compared with prior art constructions, while at the same time mechanical devices which are moved between the sterile area and the ambient surroundings are eliminated.

Still a further object of the present invention is to provide a sealing arrangement between the chamber and its surroundings which lacks mutually abutting surfaces exposed to wear and which, therefore, displays satisfactory performance even after lengthy operation.

Finally, yet a further object of the present invention is to provide an apparatus of the above-mentioned type which is not only economical to manufacture but is also cost-effective in respect of service and consumption of spare parts and treatment fluid.

SUMMARY OF THE INVENTION

The above and other objects have been attained according to the present invention in that an apparatus for treating package container blanks by means of a fluid, comprising chambers for accommodating the blanks and channels for the fluid connectible with the chambers, includes a rotary portion in which the chambers are disposed, and a fixed portion in which the channels discharge in a stator surface facing the rotary portion.

By designing the apparatus according to the present invention with a rotary portion which includes chambers for the package container blanks and constitutes one half of a valve arrangement, and a fixed portion which constitutes the other half of the valve arrangement and has channels and connections for treatment fluid, as well as inlet and outlet apertures for the package containers, conveyors or other mechanical devices which are moved between the aseptic area and its surroundings are eliminated, which reduces the risk of bacterial infection compared with prior art apparatuses. The principle involving a rotary device with conically shaped valve surfaces makes for considerably greater precision even during lengthy operation, whereby it is possible to reduce the surface area of the connection walls extending between the aseptic area and the ambient surroundings. The design of the mutually facing surfaces of the rotary and the fixed portions as a valve arrangement further simplifies the construction of the apparatus and obviates the need of individual valves and conduits, which provides a cost-effective apparatus enjoying a high degree of operational reliability.

BRIEF DESCRIPTION OF THE ACCOMPANYING DRAWINGS

One preferred embodiment of the apparatus according to the invention will now be described in greater detail, with particular reference to the accompanying, schematic Drawings, which illustrate only those details indispensable to an understanding of the present invention. In the accompanying Drawings.

DESCRIPTION OF PREFERRED EMBODIMENT

Figure 1:
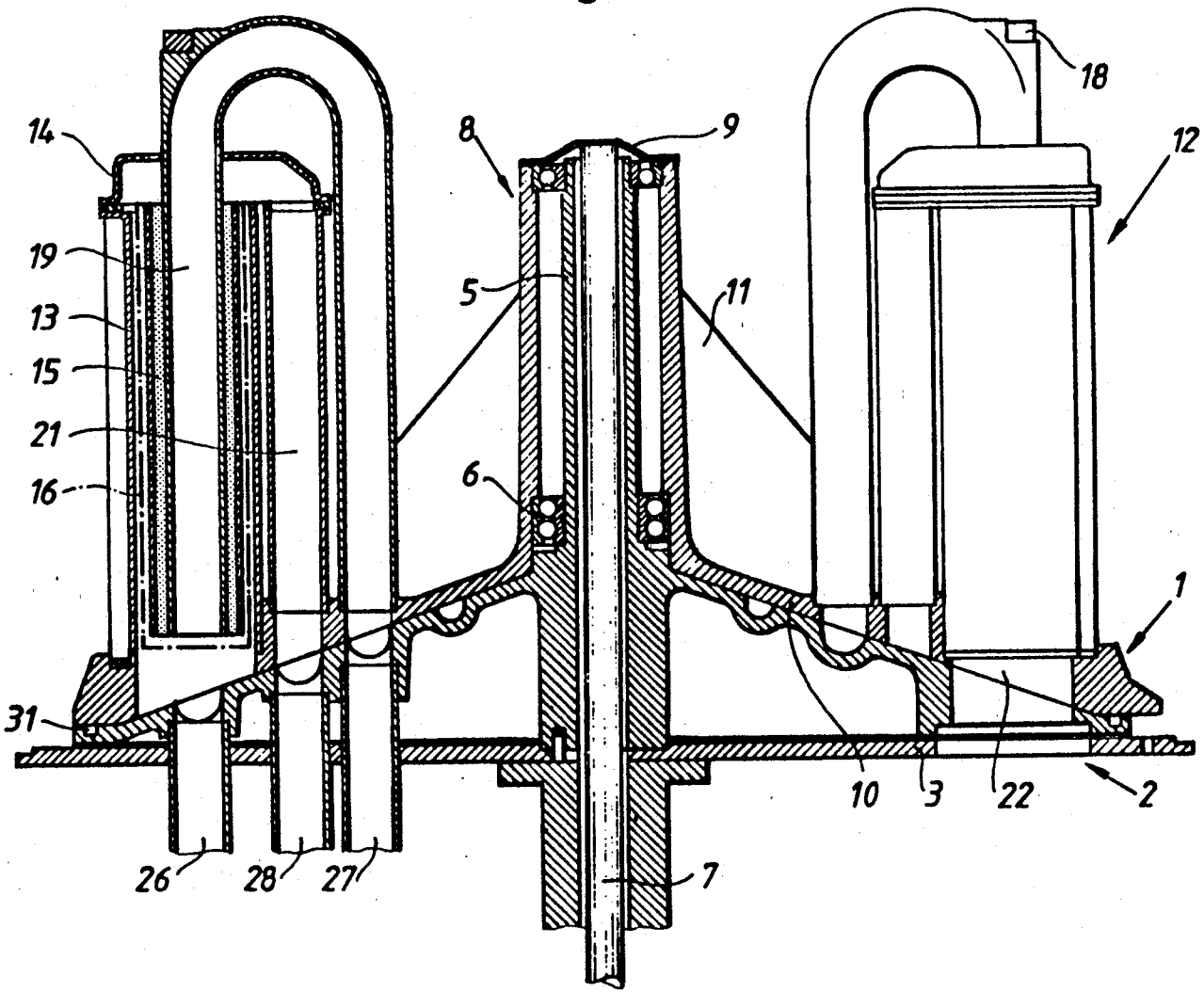
FIG. 1 is a side view, partially in section, of the apparatus according to the invention.

The embodiment of the apparatus according to the present invention shown in the Drawings is intended to constitute a part of a packaging machine for the production of aseptic package containers of the disposable type, i.e. package containers filled with, for example, sterilized long-life milk or juice. Packaging machines of this type are known in the art and normally produce, from a laminate plastic material, sleeve-shaped package container blanks which, after being sealed in a liquid-tight manner at their one end, are exposed to a disinfectant, for example gaseous hydrogen peroxide, with a view to realizing a so-called commercial sterilization, i.e. an extermination of existing bacteria to a sufficient degree to achieve desired shelf-life after filling with sterile contents and subsequent liquid-tight sealing. The package containers may be of substantially quadratic cross-section and of a height which is three to four times greater than the cross-section. Naturally, the apparatus according to the invention may also be employed for other treatment of package container blanks of various types, one condition being, however, that the treatment be carried out by means of a current of fluid which is to pass and come into contact with, in any event, the interior surface of the package container. The package containers may also be of rectangular, circular or other cross-section and may be manufactured from other materials. The sterilization fluid employed is ideally gaseous or vaporized and adapted to the relevant packaging material and the desired extermination effect.

The illustrated apparatus according to the invention includes a rotary portion or rotor 1 and a fixed portion or stator 2. The fixed portion 2 has a substantially circular base 3 and an upwardly facing, conical stator surface 4. A central, tubular portion 5 which extends up above the stator surface 4 is provided with exterior rolling bearings 6 and an interior drive shaft 7 which runs vertically downwards through the fixed portion 2 to a prime mover (not shown) located beneath the fixed portion and realizing intermittent movement, for example an electric servomotor.

The rotary portion 1 is provided with a centrally located, vertically upwardly extending journal portion 8 which, by the intermediary of the above-mentioned bearings 6, is rotatably suspended on the tubular portion 5 and is, at its upper end, connected to the upper end of the drive shaft 7 by the intermediary of a flexural coupling 9. The rotary portion 1 is provided with a downwardly facing, conical rotor surface 10 which has the same nose angle as the stator surface 4, preferably 140°, but in any event between 90° and 170°. The spacing between the stator surface 4 and the rotor surface 10 should be as slight as possible, without risking direct contact between the surfaces, and in practice a spacing of 0.1–0.3 mm has proved to be preferable.

Figure 3:
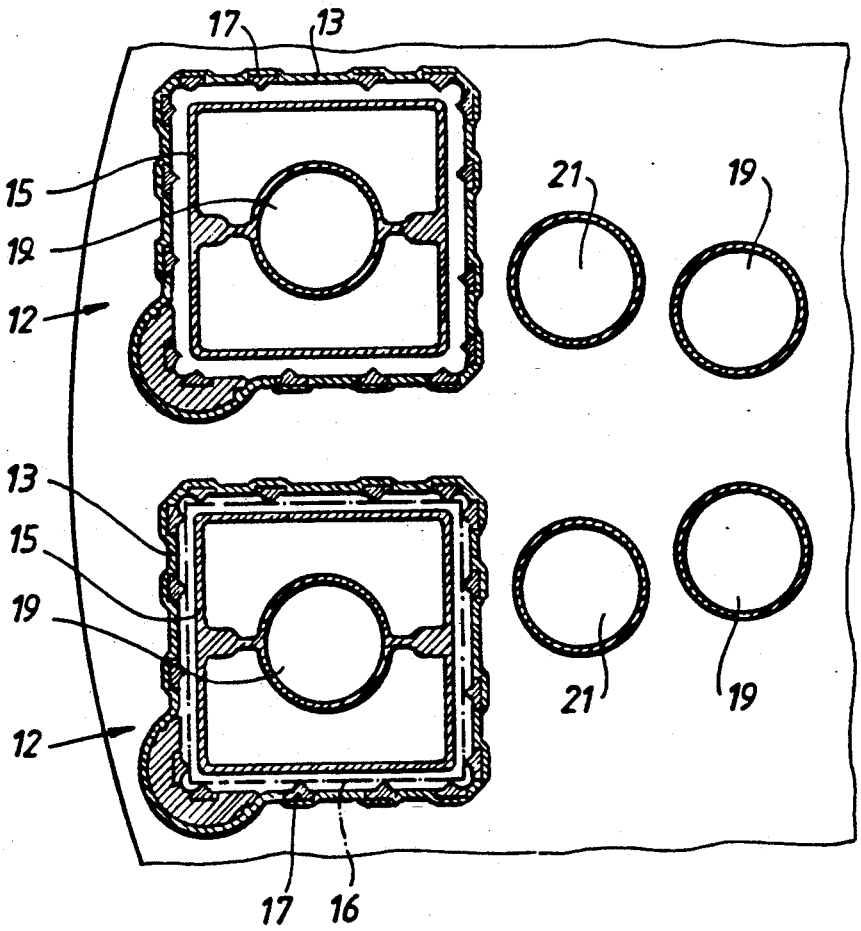
FIG. 3 is a top cross-sectional view through two adjacent chambers for accommodating package container blanks.

The rotary portion 1 is substantially circular and carries, on its upper side provided with radial rigidification webs 11, eight chambers 12 which are pairwise uniformly distributed about the rotary portion and are located in identical spaced-apart relationship from the common centre axis of the rotary portion 1 and the fixed portion 2. Each chamber 12 has a tubular chamber wall 13, a tightly sealing lid 14 disposed thereon, and a filler body 15 disposed within the chamber. Between the inside of the chamber wall 13 and the outside of the filler body 15, there is a gap for accommodating the package container blank, the gap being of a width of between 3.0 and 10.0 mm, but preferably approx. 6.0 mm. As will be apparent from FIG. 3, in which a package container blank 16 has been drawn by ghosted lines in the upper chamber, the above-mentioned gap is distributed substantially uniformly on the inside and outside of the package container blank, the package container blank being retained in position in the chamber by means of a number of preferably conical support studs 17 distributed about the chamber wall. The filler body 15 is connected to the lid 14 which, with the aid of an anchorage 18, is sealingly urged against the upper end of the chamber wall 13. The lower end of the chamber wall 13 is simultaneously urged in a gas-tight manner against the part of the rotor 1 provided with the conical rotor surface 10.

It will be apparent from FIG. 1 how each chamber 12 is in communication with channels discharging in the rotor surface 10 for the fluid which is to be circulated through the chamber. More precisely, the filler body 15 includes a central channel 19 whose one end discharges at the lower end of the filler body 15 (i.e. inside a package container blank 16 located in the chamber), and whose other end discharges, by the intermediary of a connection conduit, in the rotor surface 10 a slight distance inside the relevant chamber 12, i.e. more proximal the centre axis of the rotor 1. The chamber 12 is also provided with a lower, quadratic aperture of the same cross-sectional dimensions as the chamber, by the intermediary of which aperture the chamber is directly connected with the rotor surface 10 in order to make possible both infeed and discharge of a package container blank 16 and allow for passage of sterilization fluid along the outside of a blank 16 located in the chamber. An outlet channel 21 runs out from the upper end of the chamber 12, this channel extending down to the rotor surface 10 and discharging therein between the opening of the chamber 12 and the outlet of the central channel 19 in the rotor surface 10.

Figure 2:
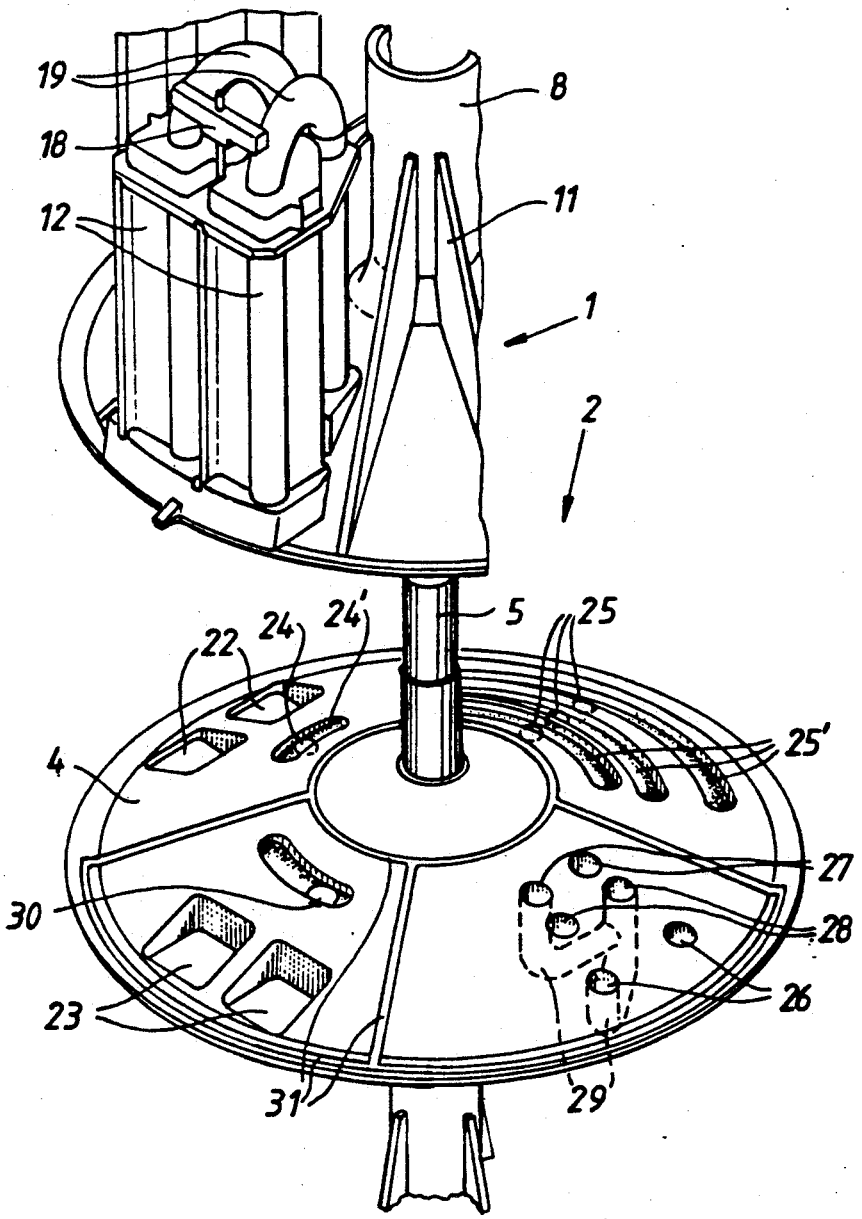
FIG. 2 is a perspective view of the apparatus according to the invention with the upper portion raised and partly removed.

The channels 19 and 21 discharging in the rotor surface 10 of the rotary portion 1 and the chambers 12 are, on rotation of the rotary portion 1, selectively connectible in a manner similar to slide valves with a number of inlets and outlets discharging in the stator surface 4 of the fixed portion 2, as will be most clearly apparent from FIG. 2. In the stator surface 4, there are pairwise disposed substantially quadratic holes for the package container blanks, the holes extending fully through the fixed portion. The hole pairs are disposed at an angle of 90° in relation to one another and comprise one pair of infeed apertures 22 and one pair of discharge apertures 23. Between the infeed apertures 22 and the centre axis of the apparatus, there is provided an air outlet port 24 which, by the intermediary of an arcuate slot 24' provided in the stator surface, is connectible with both of the centre channels 19 included in one chamber pair. The outlet port 24 is, at its other end, connectible to the ambient atmosphere.

A quarter of a turn after the described infeed position, seen in the direction of rotation (clockwise) of the rotary portion 1, there is disposed a preheating position with three preheat ducts 25 which, by the intermediary of arcuate slots 25', are connectible with both the centre channels 19, the outlet channels 21 and the chambers 12. The centrally located preheat duct 25 is an outlet channel intended to connect the outlet channel 21 with the ambient atmosphere, while both of the preheat ducts 25 disposed on either side thereof are inlet ducts for hot air (approx. 120° C.) from a conventional hot air source (not shown) to the chambers 12 and the central channels 19 in the rotor 1.

After a further 90° clockwise turn of the rotary portion 1, the relevant pair of chambers 12 reaches a sterilization position in which the chambers 12 and the central channels 19 of the chambers are communicable with two pairs of inlet channels 26, 27 for the infeed of sterilization fluid peripherally and centrally, in relation to blanks 16 inserted in the chambers. The outlet channel 21 in the rotary portion is at the same time connectible with outlet channels 28 located between the two inlet channels 26 and 27. The inlet channels 26 and 27 are preferably connectible to a generator which generates a gaseous sterilization agent, preferably gaseous hydrogen peroxide at a temperature of 80°–120° C. By the intermediary of a valve (not shown), the inlet channels 26, 27 are also connectible to a source of sterile air, for example sterile filtered air generated by means of a compressor. In a specific embodiment of the apparatus according to the present invention, an overflow channel 29 may be utilized to connect the outlet channel 28 from one of the chambers 12 included in the relevant pair with both of the inlet channels 26, 27 of the other chamber included in the pair. In such an instance, both of the chambers will be connected in series.

A further turning of the rotary portion 1 though 90° completes the revolution and places both of the chambers 12 in register with the discharge apertures 23 by the intermediary of which the package container blanks 16 disposed in the chambers may be discharged from the apparatus according to the invention. Infeed and discharge of the blanks are effected by means of conventional, for example suction-cup carriers, which engage, via the infeed and discharge apertures 22, 23, with the downwardly facing end surfaces of the blanks and displace the blanks vertically out of the chamber via the apertures 22, 23 in the stator surface 4. When the rotor is in the above-mentioned discharge position, the central channels 19 are connectible with an inlet 30 which may be placed in communication with the previously mentioned sterile air source.

As is apparent from FIG. 2, the stator surface further displays a number of grooves 31 which define, on the one hand, a sector of the stator surface within which the inlet channels 26, 27 for sterilization fluid discharge, and, on the other hand, that part of the stator surface in which the discharge apertures 23 for the package container blanks are located. The groove 31 has an inner, annular portion which, by the intermediary of radial grooves, is connected to an outer arcuate portion, and all grooves are, moreover, connectible to a partial vacuum source of conventional type by the intermediary of channels (not shown) extending through the stator surface.

When the apparatus according to the present invention is employed for treating package container blanks with a view to bacterial extermination, it is preferably disposed as a more or less integral part in a packaging machine of previously known type. The apparatus is intended to co-operate with packaging machines of the type which produces sleeve-shaped package container blanks preferably provided with a liquid-tight end wall and which, after treatment in the apparatus according to the invention, are filled with previously sterilized contents (for example UHT treated milk) and are sealed in a liquid and bacteria-tight manner. Package containers of this type are normally produced from laminated packaging material which essentially comprises layers of paper, thermoplastic (polyethylene) and aluminium foil or some other suitable barrier material. Both the package containers and the machines for their production are well-known to persons skilled in this art and probably require no detailed description in this context. It is here merely presupposed that the package containers are of sleeve shape with one sealed end wall, the containers being advanced, for example with the aid of a conventional conveyor, to the apparatus according to the present invention and being displaced into the chamber thereof by means of a reciprocating transfer device, for instance a rod fitted with a carrier and driven by means of a cam.

Infeed of a package container blank 16 into one of the eight chambers 12 of the rotary portion 1 is essentially effected vertically upwardly through one of the two infeed apertures 22 in the fixed portion 2 of the apparatus. The rotary portion 1 is, at this point, located in such a position of rotation that one chamber 12 is located immediately above one of the two infeed apertures 22, for which reason the relevant package container blank 16 may pass unimpeded the fixed portion 2 through the infeed aperture 22 in the stator surface 4 and up into the chamber 12. Since the blank 16 is raised with its open end facing upwards, the blank will be displaced up about the filler body 15 until such time as it is located in the position illustrated in FIG. 1 (the blank 16 being indicated by ghosted lines). In this position, the blank 16 surrounds the filler body 15 and is exteriorly supported by the support studs 17 of the chamber wall 13 such that the spaces between the wall of the blank 16 and the chamber wall 13 located outside the blank, and the filler body 15 located within the blank are respectively of equal size, preferably approx. 3.0 mm. No direct contact occurs between the filler body 15 and the inside of the blank 16, which is crucial for ensuring that all parts of the interior surface of the blank 16 coming into contact with the contents of the container will be accessible to the treatment or sterilization fluid which is to be employed.

Supply of blanks to the apparatus according to the present invention is preferably affected pairwise, and infeed of the blanks into both of the chambers 12 included in a pair is similarly effected simultaneously. As has been mentioned above, during infeed of the blanks, both of the chamber 12 are located immediately above the infeed apertures 22, implying that the central channels 19 of the chambers are in communication with the outlet port 24 via the slot 24', whereby air present in the chambers 12 may be forced out via the central channel 19 when the blank is displaced upwardly on the filler body 15. Hereby, placing of a blank 16 in the correct position in the chamber 12 will not be prevented by the occurrence of an air cushion, but instead transfer of a blank 16 from the conveyor (not shown) via the fixed portion 2 and into the relevant chamber 12 may take place at high speed, as is necessary since the stand time of the rotor is relatively short (of the order of 2 sec.). After the infeed of the package container blanks 16 into the relevant pair of chambers 12, the rotary portion 1 may unimpeded be turned through a quarter of a revolution, the filled chambers 12 departing from the infeed apertures 22 in order to instead progressively enter into communication with the outermost of the three preheat ducts 25 via associated, arcuate slots 25'. At the same time, the central channels 19 of the chambers enter into communication with that slot 25' which is connected to the innermost of the three preheat ducts 25, and the outlet channels 21 enter into communication with the centrally located slot 25' of the preheat duct 25. Both of the relevant blanks 16 are now located in the preheating position, and preheating is effected in that air heated to approx. 120° C. is led via the outer and inner preheat ducts 25 to the chambers 12 both to the outside of the blank 16 and its inside (via the central channel 19). Having passed the blank 16 both exteriorly and interiorly, the air from both of the ducts is gathered and led via the outlet channel 21 to the centrally located preheat duct 25. The injection of the preheating air at both the outside and the inside of the blank implies that no pressure difference between the different sides of the blank need arise, at the same time as a large volume of air may pass, which is advantageous from the point of view of realizing a rapid and uniform heating of the package container blank 16. Maximum treatment time is achieved with the aid of the arcuate slots 25' in the stator surface 4 of the fixed portion 2, the slots ensuring that the channels in the rotary portion 1 come into contact with the preheat ducts 25 as soon as they have left the infeed position, and maintain contact both during the stand time of the rotor in the preheating position and on further rotation in a direction towards the subsequent sterilization position. It will hereby be ensured that the preheating time is not limited to the approximately two seconds during which the rotary portion 1 is stationary, with the relevant chambers 12 in the preheating position, but is increased such that the preheating time also encompasses a part of the rotation time of the rotary portion 1. This ensures that the hot air at approximately 120° C. will have time to heat the blanks 16 sufficiently, i.e. to a temperature not less than approximately 80° C., which slightly exceeds the dew point of the heated mixture of sterilization agent and air which is employed for the sterilization treatment proper of the package container blanks.

As soon as the contact between the relevant chamber pair 12 and the slot 25' of the preheat ducts has been discontinued, the chambers move to the sterilization position, in which the rotor once again stops. In this position, the interior of each chamber 12 is in communication with a source of treatment fluid by the intermediary of an outer peripheral inlet 26 in the stator surface 4, the inlet being in direct connection with the chamber 12—more precisely the portion of the chamber located outside the blank 16—and a centrally located central inlet 27 which, via the central channel 19, places the sterile fluid source in communication with the inside of the blank 16. Supply of the relevant sterile fluid (preferably peroxide gas heated to approx. 80° C.) now takes place via both of the inlets 26, 27 and, after having passed the outside and inside of the blank 16, respectively, the gas flows out via the common outlet channel 21 which, in the present position of the stator, is connected to the outlet channel 28 in the stator surface 4 located between the inlets 26 and 27.

In a modified embodiment of the apparatus according to the present invention, the outlet channel 28 from one of the chambers 12 making up the pair may, via the overflow channel 29 (FIG. 2), be connected to the inlet of the second chamber 12, implying that the chambers 12 making up a pair will be connected in series so that the treatment gas first flows through one chamber and may thereafter pass through the other. It will hereby be possible to save treatment fluid. Since the supplied gas of, for example, hydrogen peroxide and air, is at a temperature of approx. 80° C., it will not condense on the blank 16 heated to above 80° C., the treatment being effected wholly in the gas phase, which has proved to be an effective method giving satisfactory extermination results in a very short time, of the order of 1 sec. Nevertheless, to ensure adequate results, the supply of treatment fluid continues for a slightly longer period, approx. 1½ sec., whereafter both of the inlet channels 26 and 27 are, via channels (not shown), instead placed in communication with a source of sterile hot air which, for a further 0.5 sec., may pass the inside and outside, respectively, of the package container blanks 16 so that residues of the sterilization fluid are completely flushed away.

When the treatment in the sterilization position is completed, the rotary portion 1 is turned through an additional quarter of a revolution to a discharge position in which both of the chambers 12 are placed in communication with a pair of discharge apertures 23 in the fixed portion 2. At the same time, both of the central channels 19 enter into connection with the inlet 30 in the stator surface 4, this inlet being in communication with a source of sterile air and, hence, feeds sterile air into the chambers 12 during the withdrawal of the treated blanks 16. The supply of sterile air facilitates withdrawal of the blanks 16, since no vacuum occurs on the relatively rapid withdrawal of the blanks, at the same time as infection of the blanks is prevented during transfer of the blanks 16 from the rotor 1 to a subsequent closed chamber (not shown), in which the blanks are, after placing on, for example, a conveyor (not shown), advanced to a filling station where previously sterilized contents are supplied to a desired level. Thereafter, the package container blanks are sealed at the remaining end wall so that the enclosed contents will remain discrete in both liquid- and bacteria-tight manner from their surroundings, whereafter the package containers may be removed from the sterile area by the intermediary of a gate of conventional type (not shown).

As has been mentioned in the foregoing, the rotary portion and the fixed portion are in slight spaced-apart relationship from one another, and the space between the stator surface 4 and the rotor surface 10 is, consequently, approx. 0.1–0.3 mm. This is necessary in order to ensure that both of the surfaces do not come into contact with each other (and be exposed to wear) on rotation, but implies at the same time that a certain leakage of treatment fluid and air will occur during operation. The leakage of sterilization fluid is an advantage, since it entails that the space will be kept bacteria-free, but it is not desirable that the sterilization fluid leak out into the ambient surroundings. In order to prevent this, the grooves 31 provided in the stator surface 4 are, by the intermediary of channels (not shown), in constant connection with a vacuum source which, by means of an equilibriated suction, ensures that leaking treatment fluid is taken care of and collected.

In the illustrated embodiment, both the stator surface 4 and the rotor surface 10 have a nose angle of approx. 140°, but other angles may of course be selected within a wide range (90°–170°) which has proved to function satisfactorily. Constructions outside this angular range are also conceivable. However, practical experiments have shown that a wholly planar surface entails a greater risk of thermal deformation and, thereby, disruptive contact between both of the surfaces, for which reason this should be avoided. On the other hand, and wholly cylindrical surface in which the chambers 12 extend radially towards the axis of rotation does not suffer from corresponding drawbacks, but instead entails practical difficulties in which for example, residues of package container blanks must be removed from the gap between the surfaces. Consequently, the choice of a nose angle of approx. 140° has been deemed as a good compromise between both of these extremes, and practical experiments have also demonstrated that this is the optimum construction. Discharge to a subsequent filling station may be dispensed with in that the filling operation instead takes place while the blanks are located in the rotor, and closure and sealing of the blanks may possibly also be effected already in the rotor.

The present invention should not be considered as restricted to that described above and shown on the Drawings, many modifications being conceivable without departing from the spirit and scope of the appended claims.

What is claimed is:

1. An apparatus for treating package container blanks with a fluid, comprising: a rotary portion mounted for rotation about a drive shaft and having a chamber mounted thereon for receiving a package container blank, and a fixed portion extending around said drive shaft and having a stator surface that faces the rotary portion, said rotary portion being rotatable relative to said fixed portion and said rotary portion having a rotor surface that faces said fixed portion, said rotor surface and said stator surface being substantially conical, said fixed portion having a first inlet channel formed therein, conduit means in said rotary portion for interconnecting said first inlet channel and said chamber at a first rotary position of said rotary portion, said fixed portion having an infeed aperture opening to the stator surface, said chamber being aligned with said infeed aperture when said rotary portion is in a second rotary position so that container blanks may be inserted into said chamber through said infeed aperture when said rotary portion is in the second rotary position and fluid may be supplied through said conduit means to said chamber upon rotation of said rotary portion to said first rotary position.

2. The apparatus according to claim 1, wherein said conical rotor surface and said conical stator surface have a nose angle of about 140°.

3. The apparatus according to claim 1, wherein said conduit means includes a central filler body extending centrally within said chamber.

4. The apparatus according to claim 3, including a space between an inner surface of said chamber and an outer surface of said central filler body for receiving a container blank.

5. The apparatus according to claim 4, wherein the distance between the outer surface of the central filler body and the inner surface of the chamber is between about 3.0 mm and about 10.0 mm.

6. The apparatus according to claim 1, wherein said fixed portion includes a plurality of preheat ducts through which hot air can be supplied to said chamber when the chamber is in a preheating position, said plurality of preheat ducts opening to the stator surface, said plurality of preheat ducts being positioned between said first inlet channel and said infeed aperture so that said chamber moves successively from said second rotary position to said preheating position and then to said first rotary position during rotational movement of the rotary portion, one of said preheat ducts being aligned with and in fluid communication with said conduit means and another of said preheat ducts being aligned with and in fluid communication with said chamber when said chamber is in the preheating position.

7. The apparatus according to claim 1, including a second inlet channel in the fixed portion which opens to the stator surface, said second inlet channel being aligned with said chamber when the rotary portion is in the first rotary position to supply sterile air to the chamber, an outlet channel provided in said fixed portion which opens to the stator surface, an outlet conduit provided in said rotary portion and communicating said chamber with said outlet channel when said rotary portion is in the first rotary position whereby fluid flowing into said chamber through said first and second inlet channels may be discharged through said outlet channel.

8. The apparatus according to claim 1, including an outlet port that opens to the stator surface and that communicates with the conduit means when the rotary portion is in the second rotary position, said outlet port being communicable with the atmosphere.

9. The apparatus according to claim 1, including a discharge aperture extending through the fixed portion for permitting a blank to be discharged from the chamber when the rotary portion is rotated so that the chamber is aligned with said discharge aperture.

10. An apparatus for treating package container blanks with a fluid, comprising:

a rotary portion having a plurality of package container blank receiving chambers provided thereon, said rotary portion having a rotor surface and said plurality of package container blank receiving chambers opening to said rotor surface; and a fixed portion having a stator surface that faces the rotor surface, said rotary portion being rotatable relative to said fixed portion and said fixed portion having a plurality of treatment stations, each treatment station being alignable with at least one of said package container blank receiving chambers, said fixed portion having infeed means at a first one of said treatment stations for permitting a package container blank to be inserted into one of the package container blank receiving chambers when the rotary portion is rotated so that the one package container blank receiving chamber is in an infeed position, said fixed portion having means for preheating a package container blank in one of the package container blank receiving chambers at a second one of said treatment stations, said fixed portion having means for sterilizing a package container blank in one of the package container blank receiving chambers at a third one of said treatment stations, and said fixed portion having means for discharging a package container blank from one of the chambers at a fourth one of said treatment stations, wherein when the rotary portion is rotated sequentially through the first, second, third and fourth treatment stations a package container blank in inserted into one of the package container blank receiving chambers, is efficiently and effectively treated and is discharged from the package container blank receiving chamber.

11. The apparatus according to claim 10, wherein said means for preheating includes at least one preheat duct provided in said fixed portion through which hot air can be supplied to the one chamber when the rotary portion is rotated so that the at least one chamber is aligned with said second treatment station.

12. The apparatus according to claim 10, wherein said means for discharging includes at least one opening extending through the fixed portion at said fourth treatment station for permitting a blank located in the one chamber to be discharged from the chamber when the rotary portion has been rotated so that the chamber is aligned with said fourth treatment station.

13. The apparatus according to claim 10, wherein said plurality of receiving chambers includes chambers that are separated and spaced apart from one another.

14. A method of treating package container blanks with a fluid, comprising the steps of:

aligning a chamber provided on a rotary portion with an aperture extending through a fixed portion;

inserting a package container blank through the aperture and into the chamber;

rotating the rotary portion relative to the fixed portion to bring the chamber into communication with an inlet channel provided in the fixed portion; and supplying fluid through the inlet channel and to the chamber to treat the package container blank.

15. The method according to claim 14, including rotating the rotary portion relative to the fixed portion to bring the chamber into communication with a preheat duct prior to treating the package container blank, and supplying heat through the preheat duct and to the chamber to heat the package container blank.

16. The method according to claim 14, including rotating the rotary portion relative to the fixed portion to bring the chamber into communication with a discharge aperture extending through the fixed portion to discharge the package container blank from the chamber.

* * * * *